US005666131A

United States Patent [19]

Togashi

[11] Patent Number: 5,666,131

[45] Date of Patent: Sep. 9, 1997

[54] ACTIVE MATRIX LIQUID-CRYSTAL DISPLAY DEVICE WITH TWO-TERMINAL SWITCHING ELEMENTS AND METHOD OF DRIVING THE SAME

[75] Inventor: Seigo Togashi, Sakado, Japan

[73] Assignee: Citizen Watch Co., Ltd., Tokyo, Japan

[21] Appl. No.: 592,443

[22] Filed: Jan. 26, 1996

Related U.S. Application Data

[63] Continuation of Ser. No. 193,130, filed as PCT/JP93/00832, Jun. 21, 1993, abandoned.

[30] Foreign Application Priority Data

Jun. 19, 1992 [JP] Japan ..... 4-184778

[51] Int. Cl.[6] ..... G09G 3/36

[52] U.S. Cl. ..... 345/91

[58] Field of Search ..... 345/90, 91; 359/58, 359/60; 349/49, 51

[56] References Cited

U.S. PATENT DOCUMENTS

| | | | |
|---|---|---|---|
| 4,730,140 | 3/1988 | Masubuchi | 345/91 |
| 4,945,352 | 7/1990 | Ejiri . | |
| 5,032,830 | 7/1991 | Kuijk | 345/91 |

FOREIGN PATENT DOCUMENTS

| | | |
|---|---|---|
| 0 508 628 A2 | 10/1992 | European Pat. Off. . |
| 63-198097 | 8/1988 | Japan . |
| 63-269197 | 11/1988 | Japan . |
| 2-13989 | 1/1990 | Japan . |
| 2-58021 | 2/1990 | Japan . |
| 2-66521 | 3/1990 | Japan . |

*Primary Examiner*—Jeffery Brier

*Attorney, Agent, or Firm*—Finnegan, Henderson, Farabow, Garrett and Dunner, L.L.P.

[57] ABSTRACT

A method of driving a two-terminal type active matrix liquid crystal display device while improving printing of image and residual image caused by the characteristics of the switching elements that change depending upon the current. The liquid-crystal display device has a plurality of data lines and scanning lines, and liquid-crystal pixels provided at the intersecting points of said data lines and said scanning lines, said liquid-crystal pixels having at least one two-terminal type switching element and being driven by a scanning signal applied to the scanning lines and by a data signal applied to the data lines. The scanning signal $\phi(n)$ has current application periods (27, 28, 32, 33) for flowing a current to the switching elements preceding the select periods (26, 31). The scanning signal further has holding periods after the select periods.

13 Claims, 7 Drawing Sheets

H(n-3)
H(n-2)
H(n-1)
H(n)
H(n+1)
H'(n-3)
H'(n-2)
H'(n-1)
H'(n)
H'(n+1)

Φ(n)
Va1
Vb1
Vb2
Va2
Vc1
Vc2
34
35
36
37
38
39
40
41
42
43
44
45

ACTIVE MATRIX LIQUID-CRYSTAL DISPLAY DEVICE WITH TWO-TERMINAL SWITCHING ELEMENTS AND METHOD OF DRIVING THE SAME

This application is a continuation of application Ser. No. 08/193,130, filed as PCT/JP93/00832 Jun. 21, 1993, now abandoned.

TECHNICAL FIELD

Liquid-crystal display devices have been widely used as flat-panel displays because they consume small amounts of electric power. Among them, an active matrix system in which a switching element is incorporated in each of the pixels is now being used in TVs and data terminals as a display element with large capacity and high quality. As switching elements, there are used a three-terminal type elements such as TFTs (thin-film transistor) and two-terminal type elements having non-linear resistive characteristics such as diodes or MIMs (metal-insulation-metal structure). The two-terminal type elements are simpler in structure than the three-terminal type elements, and their use is expected to grow in the future. The present invention is concerned with an active matrix liquid-crystal display device which uses switching elements of the two-terminal type and a method of driving the same.

BACKGROUND ART

FIG. 3 is a block diagram of an active matrix liquid-crystal display device which employs two-terminal type switching elements. On a matrix display panel 3 are arranged data lines D1, D2, - - - , DM and scanning lines S1, S2, - - - , SN in the form of a matrix. A liquid-crystal pixel 1 and a two-terminal type switching element 2 are provided corresponding to each of their intersecting points. The data lines are served with data signals from a data line driver circuit 4, and the scanning lines are served with scanning signals from a scanning line driver circuit 5. To the data line driver circuit 4 and the scanning line driver circuit 5 are connected a control circuit and a power source circuit 6 for processing clock signals and image signals 7. The element having a metal-insulator-metal (conductor) structure and non-linear current-voltage characteristics is, in many cases, used as a two-terminal type switching element. A representative MIM has a structure in which the lower electrode is composed of Ta, the insulator is composed of an anodically oxidized film (TaOx) of Ta, and the upper electrode is composed of ITO (transparent conductor), and is produced using two patterns (masks).

FIG. 2 illustrates waveforms of scanning signals and a data signal waveform in a conventional method of driving a two-terminal type active matrix liquid-crystal display device such as diode, MIM or the like (Japanese Unexamined Patent Publication (Kokai) No. 59-57288), wherein $\phi(n)$ and $\phi(n+1)$ denote scanning signals applied to the n-th and (n+1)th scanning lines.

The scanning signal has a select period for writing an electric charge that is to be stored in a liquid-crystal display pixel and a holding period for holding the electric charge. In general, the liquid-crystal display pixel must be driven with voltages of two polarities. For this purpose, therefore, the select periods include first select periods H(n) and H'(n+1) in which a voltage of positive polarity having a select potential Va1 is applied to said liquid-crystal display pixels and to said two-terminal type switching elements to write a positive electric charge onto the liquid-crystal display pixels, and second select periods H'(n) and H(n+1) in which a voltage of negative polarity having a select potential Va2 is applied to write a negative electric charge onto the liquid-crystal display pixels. Other non-select periods are the holding periods in which the potentials Vb1 and Vb2 are held.

A data signal D(m) applied to the m-th data line assumes a potential between the data potentials Vd1 and Vd2. Either amplitude modulation or pulse width modulation is used for the gradation display. FIG. 2 illustrates the latter example wherein reference numeral 12 denotes a reference potential which in principle remains equivalent even when it undergoes a change in the whole system that is expressed by a predetermined potential in this drawing. In many cases, therefore, the reference potential 12 changes depending upon a relationship relative to the power source voltage of the driver circuit. In FIG. 2, the potentials Va1, Va2, Vb1 and Vb2 are symmetrically illustrated with respect to the reference potential. These potentials, however, may be asymmetrical when the two-terminal type switching element has asymmetrical characteristics. In this embodiment, furthermore, the polarity of the select potential is inverted for the n-th and (n+1)th consecutive select periods H(n), H(n+1), H'(n) and H'(n+1), i.e., the polarity is inverted for every row. In many cases, however, the polarity may be inverted for every field.

Problems inherent in the conventional driving method will now be described with reference to FIGS. 4(A) to 4(D). The greatest problem of the active matrix liquid-crystal display device employing two-terminal type switching elements, and particularly MIMs, as switching elements may be the sticking of image and the phenomenon of residual image. FIG. 4(A) illustrates an ideal change in the light transmission factor in the case of normally white in which the gradation successively changes like white, half tone, black and half tone, and FIG. 4(B) illustrates a practical change in the light transmission factor in the same display. The waveform of a change of the transmission factor of FIG. 4(B) is not in agreement with that of FIG. 4(A). When the gradation changes from white into half tone, an image which is a little darker than the half tone appears for a predetermined period of time as designated at 17. When the gradation changes from black into half tone, on the other hand, an image which is a little brighter than the half tone appears for a predetermined period of time as designated at 18. This is due to a change in the threshold voltage Vth of the switching element. This change is dependent upon the amount of current that flows through the switching element. When the state of a large current continues to some extent, the threshold voltage Vth tends to increase and when the state of a small current continues to some extent, on the other hand, the threshold voltage Vth tends to decrease. The amount of current flowing through the switching element varies depending upon the voltage that is applied during the select period, and the voltage that is applied varies depending upon the degree of gradation that is displayed. In the case of normally white, the current increases toward the darker side and when the gradation is changed as shown in FIG. 4(A), the amount of current flowing through the switching element changes as shown in FIG. 4(C). Therefore, a change in the threshold voltage becomes as shown in FIG. 4(D); i.e., residual image and sticking of image take place for a predetermined period of time from when the gradation is changed until the gradation is stabilized. The threshold voltage Vth changes either in white condition or in black condition. In principle, therefore, the sticking of image takes place either in white condition or in black condition. Under the white or black condition, however, the transmission factor changes little depending upon the applied voltage, and the printing of image the most remarkably takes place under the half tone.

In the two-terminal type active matrix liquid-crystal display device which employs the switching element of which the characteristics change depending upon the amount of current that flows as described above, there arises the problem of sticking of image and residual image caused by a change in the characteristics. According to the conventional driving method, therefore, the current flows through the switching element in amounts that vary depending upon the gradation displayed on the liquid crystal pixel, and this phenomenon cannot be removed. The object of the present invention is to provide a driving method which is capable of improving the sticking of image and the phenomenon of residual image by passing a current through the switching element in an amount greater than that of the prior art.

DISCLOSURE OF THE INVENTION

In order to accomplish the above-mentioned object, the method of driving the active matrix liquid-crystal display device of the present invention is characterized by the use, as a scanning signal, of a signal which has select periods, current-application periods which precede the select periods and holding periods that succeed the select periods. The basic technical constitution therefor is concerned with a two-terminal type active matrix liquid-crystal display device which has a plurality of data lines and scanning lines, and liquid-crystal pixels provided for the intersecting points of said data lines and said scanning lines, said liquid-crystal pixels having at least one two-terminal type switching element and being driven by a scanning signal applied to the scanning lines and by a data signals applied to the data lines, wherein said scanning signal has select periods for writing an electric charge that is to be stored in said liquid-crystal pixels, current-application periods for applying a current to said switching elements preceding said select periods, and holding periods succeeding said select periods.

Another technical constitution of the present invention is concerned with a method of driving the above-mentioned liquid-crystal display device.

BEST MODE FOR CARRYING OUT THE INVENTION

Embodiments of the present invention will now be described in detail with reference to the drawings.

Figure 8:
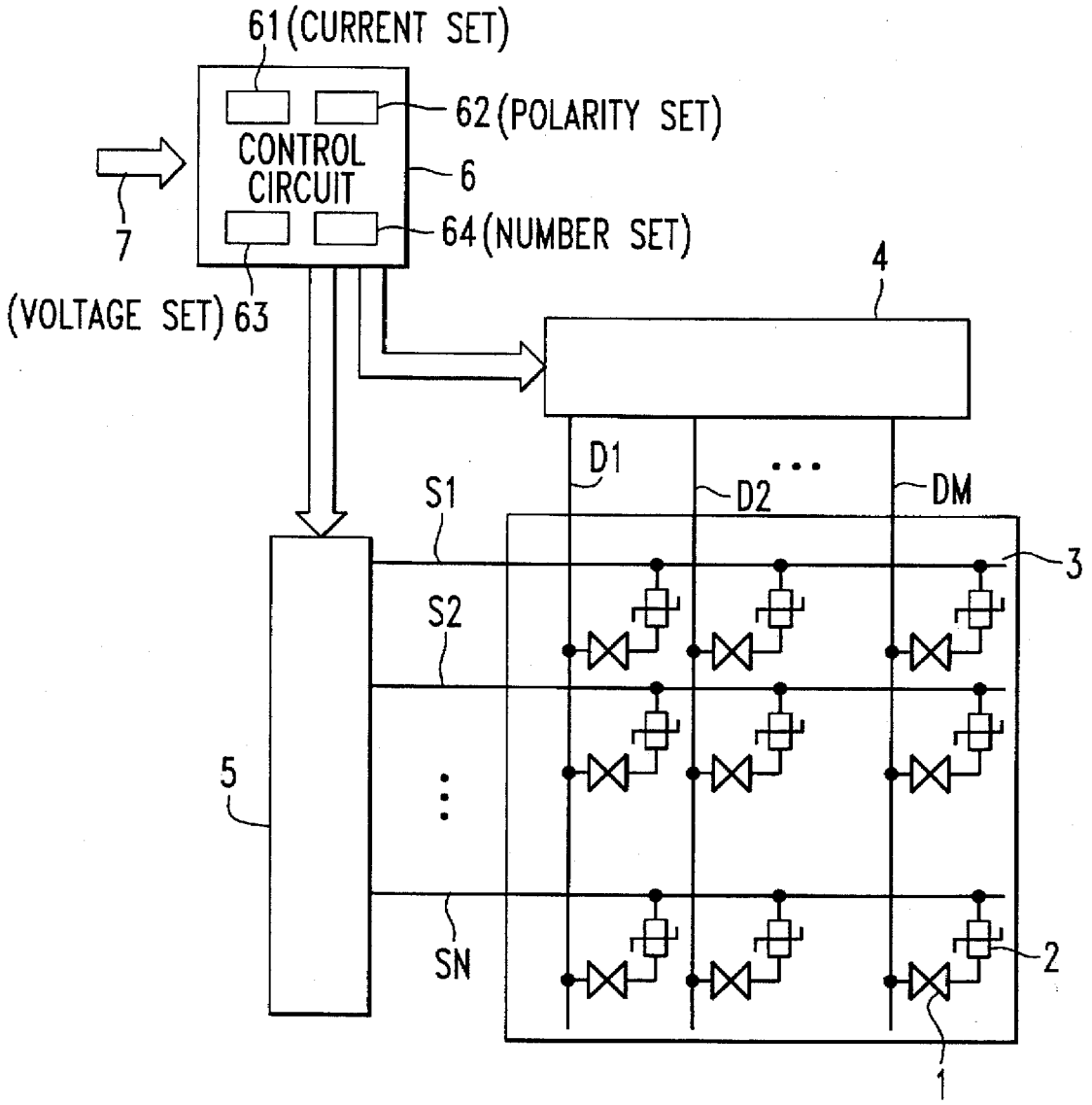
FIG. 8 is a block diagram illustrating the constitution of the liquid-crystal display device according to the present invention.

FIG. 8 is a block diagram illustrating the constitution of an active matrix liquid-crystal display device according to the present invention. The basic constitution is substantially the same as that of a conventional liquid-crystal display device shown in FIG. 3, and the portions having the same functions are denoted by the same reference numerals but are not described in detail here.

Figure 3:
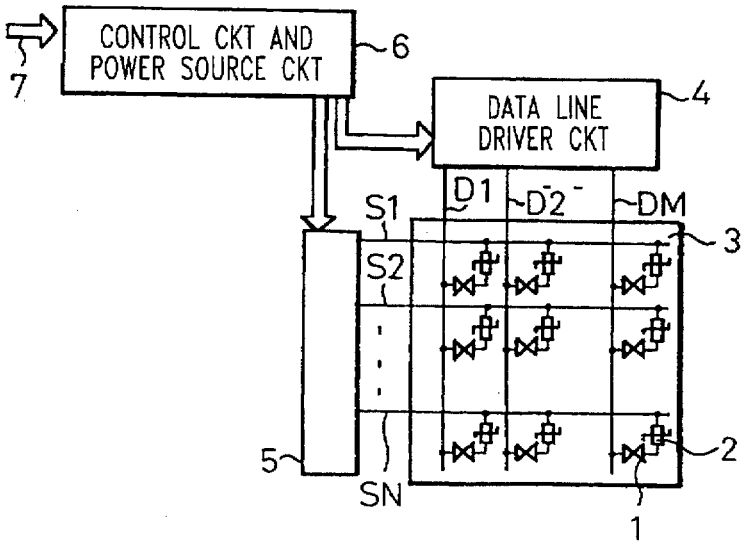
FIG. 3 is a block diagram of a representative active matrix liquid-crystal display device employing two-terminal type switching elements.
Figures 4A, 4B, 4C, 4D:
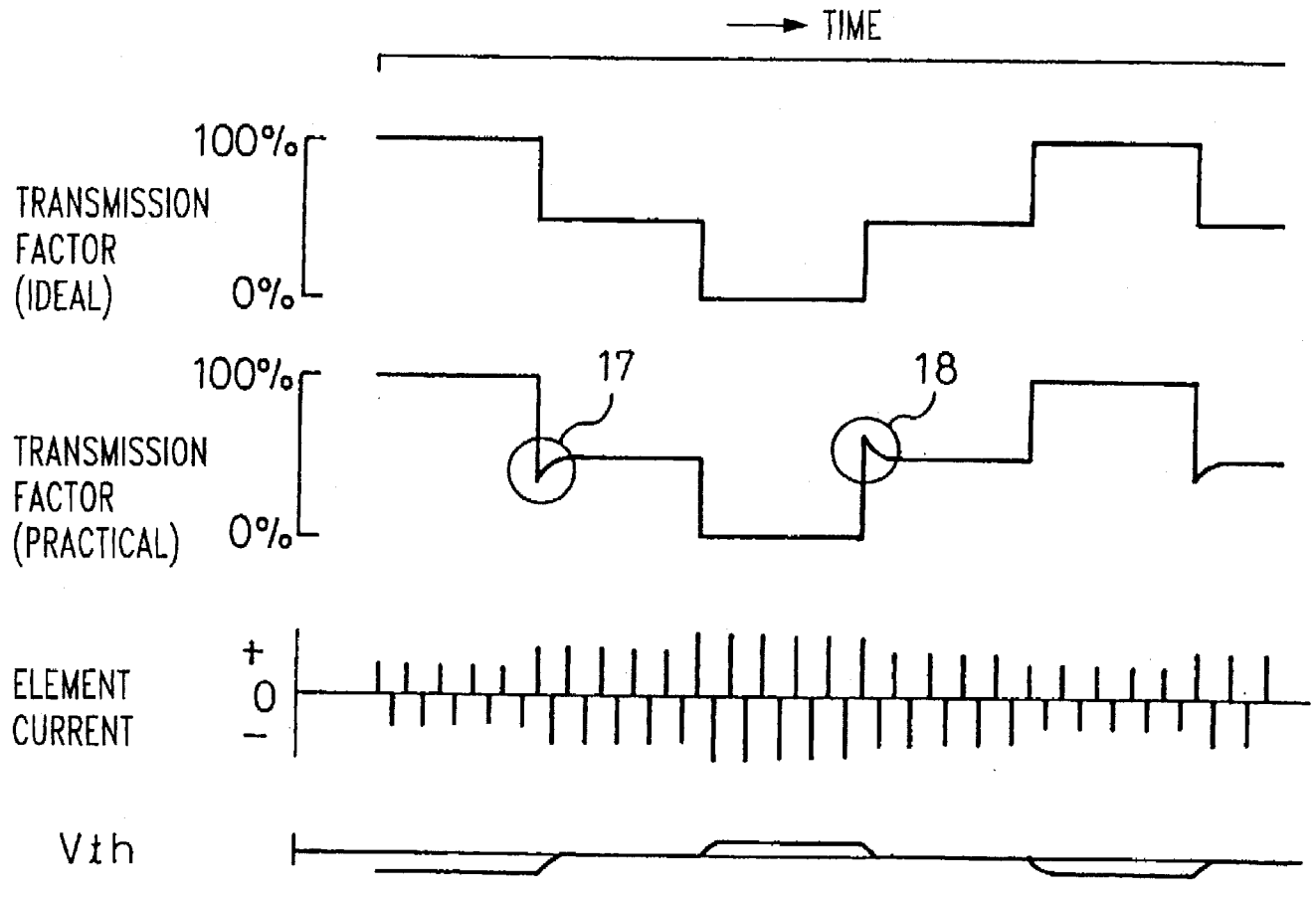
FIG. 4(A) to FIG. 4(D) are diagrams for explaining problems in a conventional driving method.

The active matrix liquid-crystal display device according to the present invention is different from the conventional active matrix liquid-crystal display device of FIG. 3 with respect to a control circuit 6. According to the present invention, the control circuit 6 is provided with a current application period setting means 61 which sets current application periods for applying a current to the two-terminal type switching elements 2 preceding the select periods, a polarity setting means 62 which determines the polarity of the current applied to the two-terminal type switching elements 2 during said current application periods, a voltage setting means 63 that determines a voltage applied to the two-terminal type switching elements 2, and an application number setting means 64 which determines a number of times of applying the current to the two-terminal type switching elements 2. These means are controlled by a suitable control means.

That is, FIG. 8 illustrates the constitution of the liquid-crystal display device according to the present invention, i.e., illustrates a two-terminal type active matrix liquid-crystal display device which has a plurality of data lines and scanning lines, liquid-crystal pixels provided for the intersecting points of said data lines and said scanning lines, said liquid-crystal pixels having at least one two-terminal type switching element, and further has a control means that includes a control circuit for controlling said scanning lines, said data lines, said liquid-crystal pixels, and said two-terminal type switching elements, said liquid-crystal display pixels being driven by a scanning signal applied to the scanning lines and by a data signal applied to the data lines in response to a control signal from said control means, wherein said control means comprises a current application period setting means which sets current application periods for applying a current to said two-terminal type switching elements 2 preceding predetermined select periods in which at least said scanning signal writes an electric charge that is to be stored in said liquid-crystal display elements, a polarity setting means which determines the polarity of the current applied to said two-terminal type switching elements 2 during said current application periods, a voltage setting means that sets a voltage applied to the two-terminal type switching elements 2, and a current application number setting means 4 which sets a suitable number of times of applying the current to said two-terminal type switching elements 2.

FIG. 8 further illustrates a block diagram of a two-terminal type active matrix liquid-crystal display device which has a plurality of data lines and scanning lines, and liquid-crystal pixels provided for the intersecting points of said data lines and said scanning lines, said liquid-crystal pixels having at least one two-terminal type switching element and being driven by a scanning signal applied to the scanning lines and by a data signal applied to the data lines, wherein said scanning signal has select periods for writing an electric charge that is to be stored in said liquid-crystal pixels, current application periods for applying a current to said two-terminal type switching elements preceding said select periods, and holding periods for holding the electric charge of said liquid-crystal display pixels succeeding said select periods.

According to the method of driving liquid crystals of the present invention, furthermore, the scanning signal has first select periods for applying a voltage of a first polarity to the liquid-crystal display pixels and to said two-terminal type switching elements and second select periods for applying a voltage of a second polarity thereto, and wherein a voltage of a polarity opposite to that of the voltages of said select periods is applied to said two-terminal type switching elements in the current application periods which precede said select periods.

Moreover, according to the present invention, the scanning signal has first select periods for applying a voltage of a first polarity to the two-terminal type switching elements and second select periods for applying a voltage of a second polarity thereto, and wherein the current application periods which precede said select periods have a potential equal to the potential of said select periods in order to effect the writing of a polarity opposite to that of said select periods.

In the driving method of the present invention, the scanning signal has first select periods for applying a voltage of a first polarity to said two-terminal type switching elements and second select periods for applying a voltage of a second polarity thereto, and wherein in the current application periods which precede said select periods, a voltage of a polarity opposite to that of the voltages of said select periods and a voltage of a polarity same as that of said select periods are applied to said two-terminal type switching elements.

According to the present invention, it is desired that the scanning signal has first select periods for applying a voltage of a first polarity to said two-terminal type switching elements and second select periods for applying a voltage of a second polarity thereto, and wherein the current application periods which precede said select periods have a potential equal to the potential of the select periods to effect the writing of a polarity opposite to that of said select periods or has a potential of a polarity which is the same as that of said select periods and is equal to the potential of said select periods.

In the method of driving liquid crystals of the present invention, on the other hand, the scanning signal has first select periods for applying a voltage of a first polarity to said two-terminal type switching elements and second select periods for applying a voltage of a second polarity thereto, and wherein in the current application periods which precede said select periods, the potential may have an absolute value that is greater than the absolute value of the potential of said select periods, and the length of the current application periods of said scanning signal may be equal to the length of said selection periods.

In the method of driving liquid crystals of the present invention, furthermore, the length of the current application periods of said scanning signal may be longer than the length of the select periods, or the current application periods of said scanning signal may utilize the select periods of a scanning signal that is applied to other scanning lines.

Next, in the method of driving liquid crystals of the present invention, the select periods of said scanning signal may be continuous to the current application periods that precede said select periods, and a period may be inserted between the current application periods of said scanning signal and the select periods, said period having a potential which applies no current to the two-terminal type switching elements.

Moreover, when an intermediate value between a maximum value and a minimum value assumed by said data signal during the respective periods is regarded as a reference potential, said reference potential may undergo a change during the select periods and during the current application periods that precede said select periods.

FIGS. 1(A) to 1(D) illustrate a driving method according to an embodiment of the present invention, wherein $\phi(n)$ and $\phi(n+1)$ denote scanning signals applied to the n-th and (n+1)th scanning lines. This embodiment deals with a so-called every-row inversion as will be obvious from the select polarities of the periods shown in FIG. 1(C)24. The present invention is in no way limited to the every-row inversion only but can be effectively adapted to the frame inversion or to the intra-row inversion, as a matter of course. The scanning signal $\phi(n)$ has a select period H(n) of positive polarity and a select period H'(n) of negative polarity, and the scanning signal $\phi(n+1)$ has a select period H'(n+1) of positive polarity and a select period H(n+1) of negative polarity. These signals have a select potential Va1 when they are of positive polarity and a select potential Va2 when they are of negative polarity. The periods that follow the select periods are holding periods. A potential Vb1 is held in a holding period that succeeds the select period of positive polarity, and a potential Vb2 is held in a holding period that succeeds the select period of negative polarity. In this embodiment, periods 26 and 31 assume select potentials Va1 and Va2 in the select periods H(n) and H'(n), and the potentials Vb1 and Vb2 are held in other periods. It is, however, also allowable to assume the select potentials through the whole period.

According to the present invention, the feature resides in the periods that precede the select periods. In the scanning signal $\phi(n)$, there exist periods in which no holding potential is assumed in the periods H(n−1) and H(n−2) that precede the select period H(n) of positive polarity. These periods which are called current application periods correspond to 27 and 28 in FIG. 1. A voltage written onto and stored in the liquid-crystal pixels is determined by a select potential period 26 of the select period H(n), and a period which is just preceding does not seriously affect the image. According to the present invention, the feature resides in that a current is applied while impressing a large voltage upon the two-terminal type switching elements by utilizing the above period which least affects the image. Concretely speaking, a period H(n−1) just preceding the select period H(n) of positive polarity is provided with a period 27 for applying a large potential of different polarity or, in this case, for applying the select potential Va2 of negative polarity, and a preceding period H(n−2) thereof is provided with a period 28 for applying a large potential of a polarity different from that of the period 27 or, in this case, for applying the select potential Va1 of positive polarity. The same holds true even for the select period H'(n) of negative polarity. That is, the period H'(n−1) which just precedes is provided with a period 32 for applying a large potential of a different polarity or, in this case, for applying the select potential Va1 of positive polarity and a preceding period H'(n−2) thereof is provided with a period 33 for applying a large potential of a polarity different from that of the period 32 or, in this case, for applying the select potential Va2 of negative polarity.

In this embodiment, the period H(n−1) which just precedes the select period H(n) is provided with, for example, a period 29 in addition to the current application period 27. Similar periods are provided even for the periods 30, 20 and 21. These periods need not necessarily be provided. That is, there arises no problem even when H(n−1)=27 and H(n−2)=28. Depending upon the scanning line driver circuit, however, provision of the periods 29, 30, 20 and 21 is advantageous. In the case of a driver circuit which generates scanning signals that change in the order of, for instance, Va1→Vb1→Va2→Vb2, the signal of the present invention can be generated by simply changing the timing but without changing the circuit.

Figures 1A, 1B, 1C, 1D:
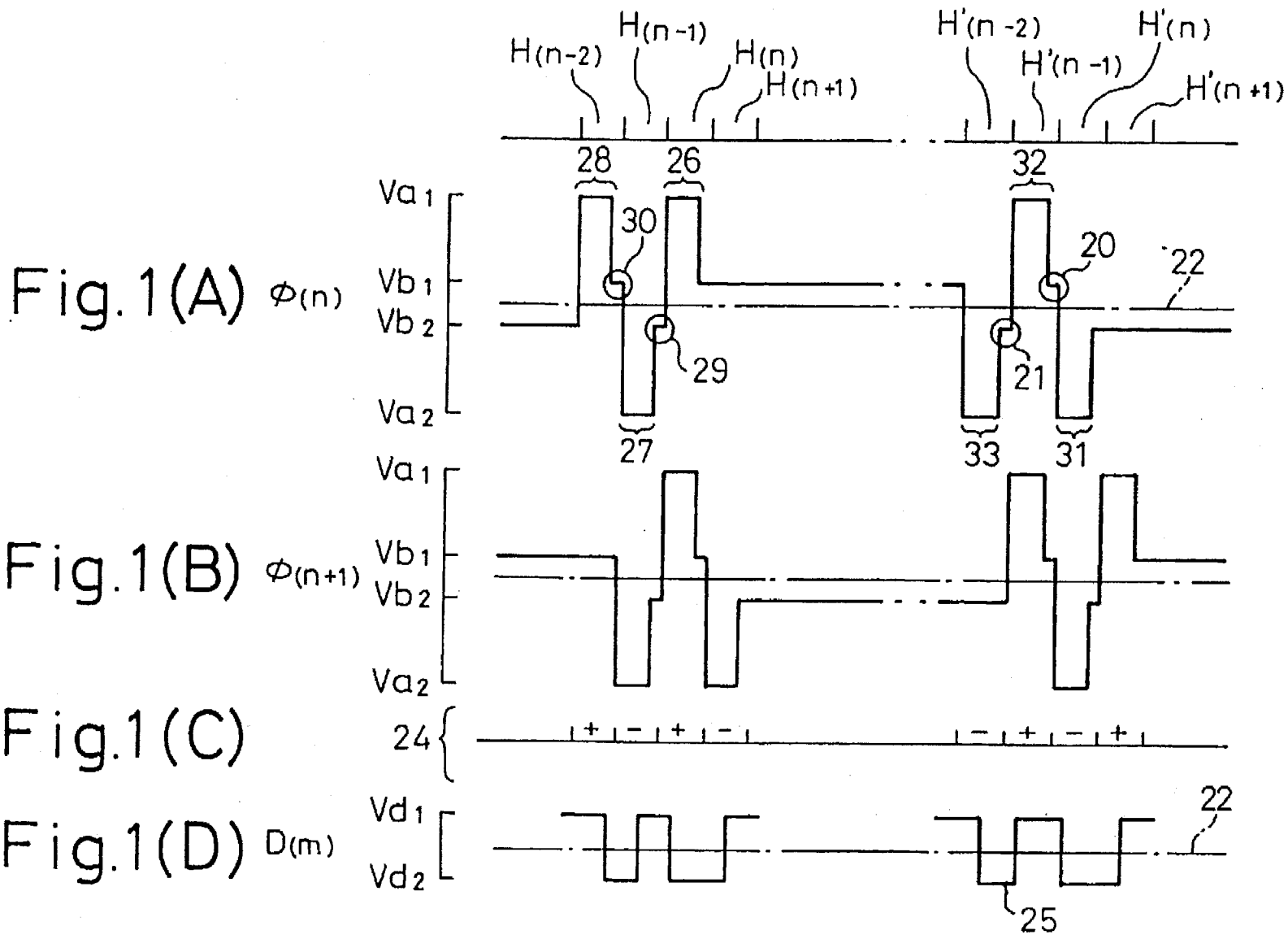
FIG. 1(A) to FIG. 1(D) are diagrams of driving waveforms in a method of driving an active matrix liquid-crystal display device according to an embodiment of the present invention.
Figure 2:
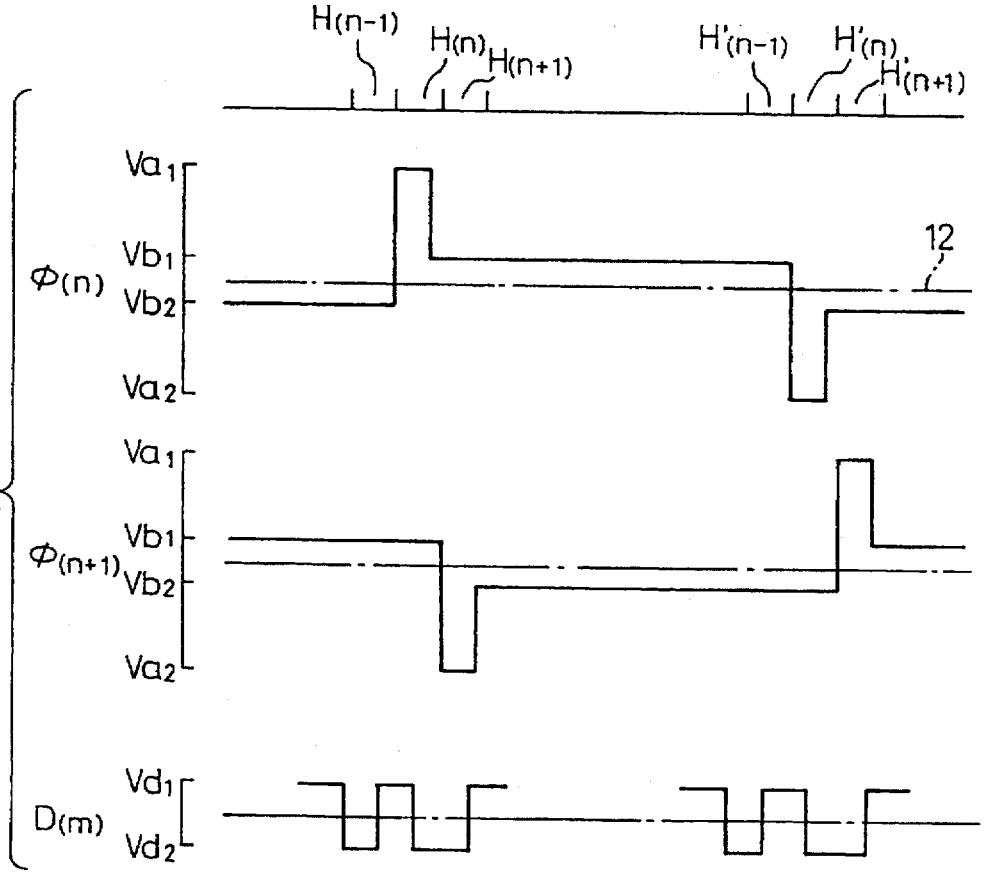
FIG. 2 is a diagram of driving waveforms in a conventional method of driving a two-terminal type active matrix liquid-crystal display device.

A data signal D(m) applied to an m-th data line assumes a potential between the data potentials Vd1 and Vd2 like 25 in the same manner as the prior art of FIG. 2. Either amplitude modulation or pulse-width modulation is employed for the gradation display. FIGS. 1(A) to 1(D) illustrate the latter case. Reference numeral 22 denotes a reference potential which in this diagram is expressed as a predetermined potential but may vary in the whole system. Though FIG. 1 shows the potentials Va1, Va2, Vb1 and Vb2 which are symmetrical relative to the reference potential, they may often be asymmetrical relative to the reference potential. Moreover, though this embodiment corresponds to the case of every-row inversion, the invention may further be adapted to the field inversion or to the intra-row inversion.

FIGS. 6(A) to 6(D) illustrate a scanning signal ϕ(n) according to another embodiment of the present invention. The timings correspond to those of the scanning signal ϕ(n) used in the embodiment of FIGS. 1(A) to 1(D), and the select periods H(n), H'(n) and the succeeding holding periods are the same, but the current application periods only are different.

Figures 6A, 6B, 6C, 6D:
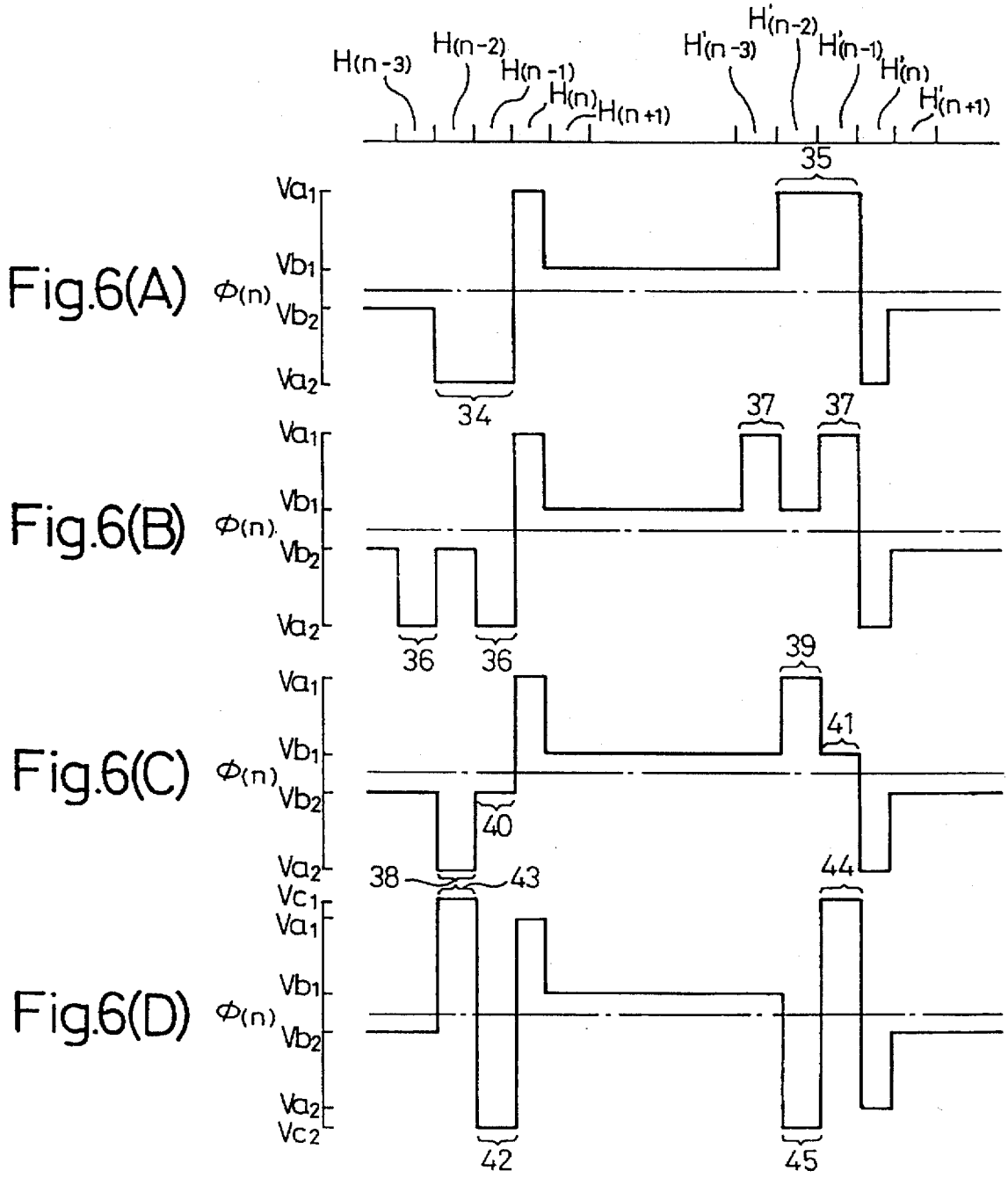
FIG. 6(A) to FIG. 6(D) are diagrams of scanning signal waveforms in the driving method according another embodiment of the present invention.

Current application periods 34 and 35 of the scanning signal ϕ(n) of the embodiment of FIG. 6(A) span across two rows of periods H(n−1), H(n−2) and H'(n−1), H'(n−2) which just precede the select periods H(n) and H'(n), and are assuming the same polarities and the same potentials. When the above method is employed for the method of every-row inversion, there is obtained a merit in that an average value of data signals of the two rows is closer to a predetermined value than that of one row, and that a current that flows into the switching elements during the current application periods varies little depending upon the image.

Current application periods 36, 37 of the scanning signal ϕ(n) of the embodiment of FIG. 6(B) span across the periods H(n−1), H'(n−1) of one row before and across the periods H(n−3), H'(n−3) of three rows before the select periods H(n) and H'(n), and are assuming the same polarities and the same potentials. In the case of the every-row inversion method, when H(n) is a select period of the scanning signal ϕ(n) of positive polarity, the period H(n−1) of one row before and the period H(n−3) of three rows before correspond to the select periods of scanning signals ϕ(n−1) and ϕ(n−3) of negative polarity. In this embodiment, therefore, the potential Va2 of the current application period 36 of ϕ(n) has a polarity and a value which are the same as those of the select potential of a scanning signal on a scanning line that is selected at the same time. Similarly, the potential Va1 of the current application period 37 has a polarity and a value same as the select potential of scanning signals ϕ(n−1) and ϕ(n−3) on the scanning lines that are selected at the same time. When the potential of the current application periods has a polarity the same as that of a scanning signal on a scanning line that is selected at the same time, it is then allowed to decrease the voltage amplitude in the circuit employed in the power-source fluctuation method or in the reference potential fluctuation method of FIGS. 7(A) and 7(B). When the same potential is employed, furthermore, the number of the potentials can be decreased.

Current application periods 38, 39 of the scanning signal ϕ(n) of the embodiment of FIG. 6(C) are the periods H(n−2), H'(n−2) of two rows before the select periods H(n), H'(n), and assume a polarity opposite to that of the potential in the select periods. The periods 40 and 41 assume the holding potentials Vb2, Vb1. In the case of the every-row inversion method, when H(n) is a select period of the scanning signal ϕ(n) of positive polarity, the period H(n−2) of two rows before corresponds to the select period of a scanning signal ϕ(n−2) of positive polarity. In this embodiment, therefore, the potential Va2 of the current application period 38 of ϕ(n) has a polarity opposite to that of the select potential of a scanning signal on a scanning line that is selected at the same time. Similarly, the potential Va1 of the current application period 39 has a polarity opposite to that of the select potential of a scanning signal ϕ(n−2) on a scanning line that is selected at the same time. Thus, when the potential of the current application period has a polarity opposite to that of the scanning signal on a scanning line that is selected at the same time, an advantage is obtained in preventing the printing though it becomes disadvantageous with respect to the voltage amplitude in a circuit employed in the power source fluctuation method or in the reference potential fluctuation method of FIG. 7. In general, the spatial frequency of an image is relatively low, and the gradation of image in many cases resembles the neighboring n-th row and (n−2)th row. For instance, it is presumed that both the n-th row and (n−2)th row have a black (maximum voltage) gradation in the normally white mode. A maximum current flows in the select period H(n) of ϕ(n) but a minimum current flows in the current application period since the voltage of ϕ(n) has an opposite polarity. In the case of white (minimum voltage) gradation, on the other hand, a minimum current flows in the select period H(n) of ϕ(n) but a maximum current flows in the current application period since the voltage of ϕ(n) has an opposite polarity. Thus, the current as a whole is averaged, and the sticking of image becomes the smallest.

In the above-mentioned embodiment, the potential during the current application periods is the same as the select potential Va1, Va2 giving great advantage from the standpoint of decreasing the number of power sources for the circuits. In the present invention, however, the potential need not necessarily be the same as the select potential. In the scanning signal ϕ(n) of the embodiment of FIG. 6(D), the potential in the current application periods is Vc1 during the periods 43 and 44, and is Vc2 during the periods 42 and 45, which are greater than the select potential.

Figures 7A, 7B:
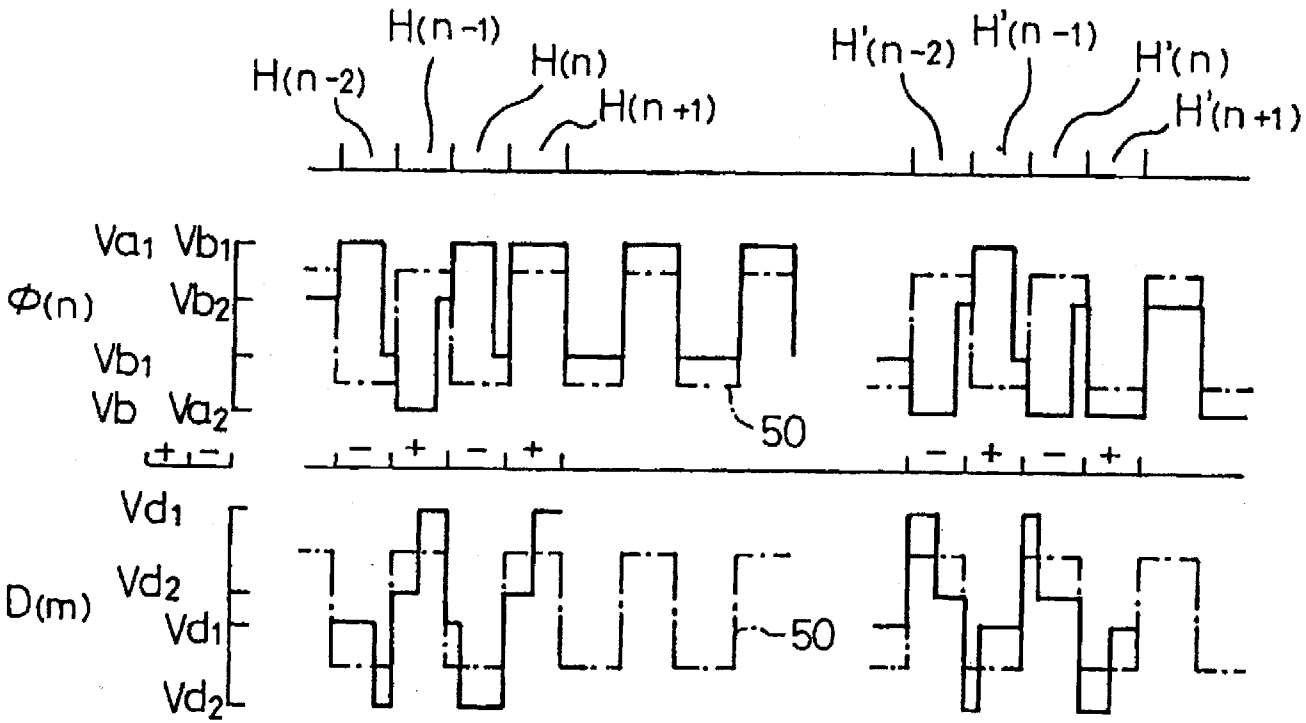
FIG. 7(A) and FIG. 7(B) are diagrams of driving waveforms in the driving method according to another embodiment of the present invention.

FIGS. 7(A) and 7(B) illustrate an example which in principle is quite equivalent to that of FIG. 1, and in which the reference potential 22 of FIGS. 1(A) to 1(D) is varied for every row as designated at 50 to decrease the amplitude of the scanning signal. The amplitude of the data signal is increased, on the other hand. The driving waveforms are equivalent though they appear to be different. The present invention encompasses even such a fluctuated potential provided it is equivalent as described with the reference potential fixed.

The above embodiment has dealt with the cases of current application periods of one row and two rows. The invention, however, can be adapted even to the cases of three or more rows. The same holds even for the continuous or discrete cases. Similarly, the holding period need not be continuous after the select periods.

EFFECTS OF THE INVENTION

As explained with reference to FIGS. 4(A) to 4(D), the greatest problem inherent in the conventional method of driving the active matrix liquid-crystal display device using two-terminal type switching elements is the sticking of image and the phenomenon of residual image caused by the threshold voltage Vth of the switching element that changes depending upon the amount of current that flows. According to the present invention, the sticking and residual image are decreased by providing current application periods, forcibly applying a current to the switching elements and stabilizing the threshold value Vth.

Figures 5A, 5B, 5C, 5D:
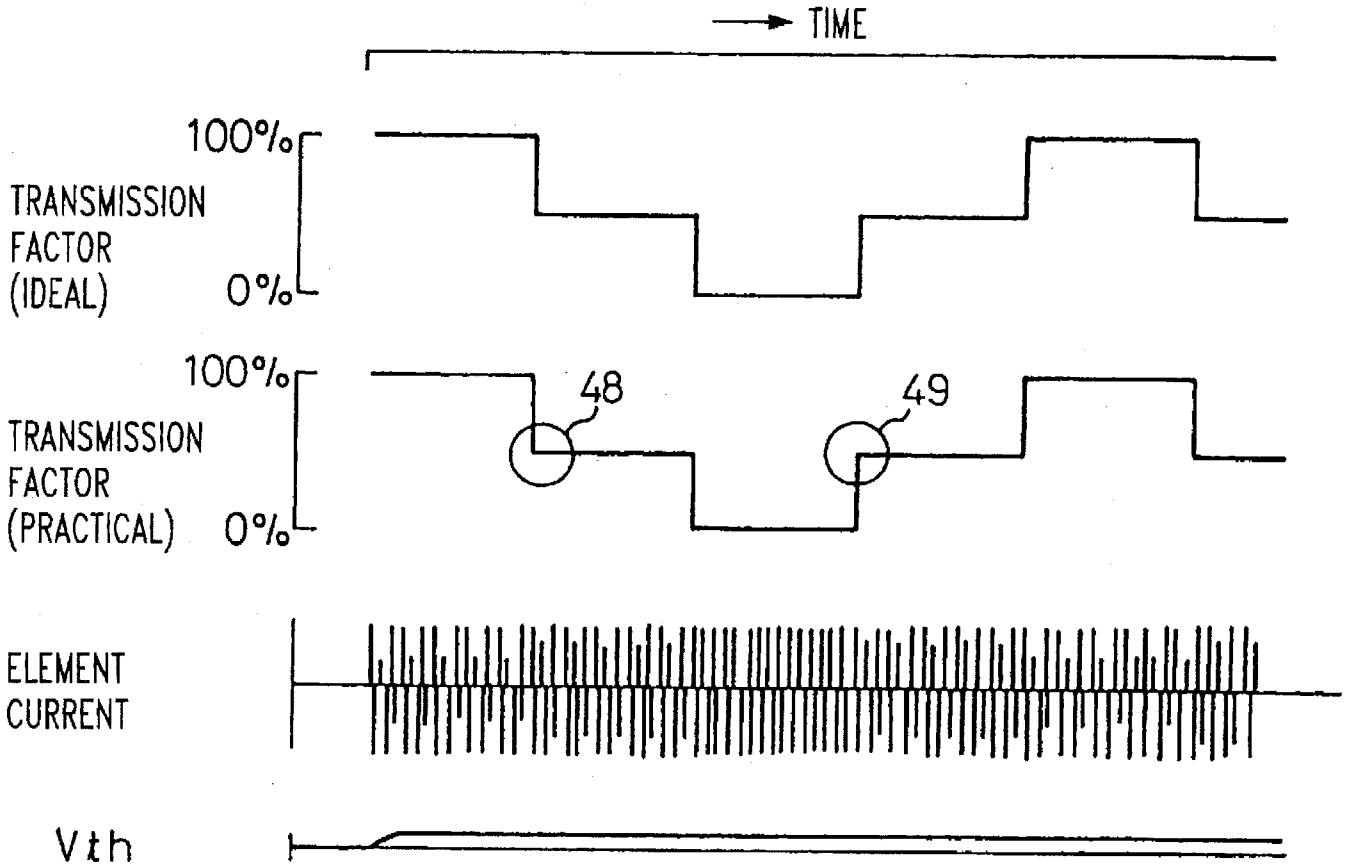
FIG. 5(A) to FIG. 5(D) are diagrams for explaining the effects of a driving method according to the present invention.

Effects of the invention will now be described with reference to FIG. 5. In the embodiment of FIGS. 1(A) to 1(D), for instance, two current application periods having different polarities are provided before the select periods and a current is forcibly applied to the switching elements. The current flowing into the elements shown in FIG. 5(c) has increased three times as great as the current shown in FIG. 4(C), so that the frequency of the switching operation of the switching element in FIG. 5(C) is three times as great as that of the switching element in FIG. 4(C). In the embodiment of FIG. 1, though there still is a difference in the amount of current caused by gradation, a change in Vth caused by the gradation is smaller in FIG. 5(D) than in FIG. 4(D) owing to an increase in the absolute amount. As a result, greatly decreased sticking 48, 49 appear in the practical change in the transmission factor of FIG. 5(B) compared with the ideal change in the transmission factor of FIG. 5(A). The effects of improvement are slightly greater in FIGS. 6(A), 6(C) and 6(D) than in FIG. 6(B).

I claim:

1. A method of driving a two-terminal type active matrix liquid-crystal display device which has a plurality of data lines and scanning lines, and liquid-crystal pixels provided for the intersecting points of said data lines and said scanning lines, said liquid-crystal pixels having a two-terminal type switching element and a liquid crystal element and being driven by a scanning signal applied to the scanning lines and by a data signal applied to the data lines, wherein said two-terminal type switching element has bipolar characteristics and can both charge and discharge the liquid-crystal element, the method comprising:

controlling said scanning signal to write during select periods, an electric charge for storage in said liquid-crystal elements charged by said bipolar two-terminal type switching elements, applying a current to said bipolar two-terminal type switching elements and discharging the stored charge in said liquid-crystal elements by said same bipolar two-terminal type switching elements during current application periods preceding said select periods, and holding the electric charge of said liquid-crystal elements during holding periods succeeding said select periods.

2. A method of driving a two-terminal type active matrix liquid-crystal display device according to claim 1, comprising applying a voltage of a first polarity to said liquid crystal elements and to said two-terminal type switching elements during first select periods of the scanning signal, applying a voltage of a second polarity to said liquid crystal elements and to said two-terminal type switching elements during second select periods of the scanning signal; and applying to said two-terminal type switching elements a voltage of said second polarity in current application periods preceding said first select periods and a voltage of the first polarity in current application periods preceding said second select periods.

3. A method of driving a two-terminal type active matrix liquid-crystal display device according to claim 2, comprising applying a voltage to the pixels in the current application periods which precede said first and second select periods, said applied voltage having a potential equal to the potential of the voltage applied to said pixels in the corresponding first and second select periods.

4. A method of driving a two-terminal type active matrix liquid-crystal display device according to claim 1, wherein said scanning signal has first and second select periods, said method comprising:

applying a voltage of a first polarity to said two-terminal type switching elements during first select periods;

applying a voltage of a second polarity to said two-terminal type switching elements during second select periods;

applying a voltage of the second polarity in current application periods which precede said first select periods;

applying a voltage of the first polarity in current application periods which precede said second select periods; and applying to said two-terminal type switching elements a voltage of a polarity the same as that of said first and second select periods.

5. A method of driving a two-terminal type active matrix liquid-crystal display device according to claim 4, comprising: applying a voltage to said pixels in the current application periods which precede said select periods, said voltage having a potential equal to the potential of the voltage applied to said pixels in one select period, in which an electric charge having opposite polarity to that of the electric charge, used in said one select period, is written, or applying a voltage potential to said pixel having a potential equal to the potential of the voltage applied to said pixels in another select period in which an electric charge having the same polarity as that of the electric charge, used in said one select period.

6. A method of driving a two-terminal type active matrix liquid-crystal display device according to claim 1, wherein said scanning signal has first select periods for applying a voltage of a first polarity to said two-terminal type switching elements and second select periods for applying a voltage of a second polarity thereto, and wherein in the current application periods which precede said select periods, the absolute value of the potential is greater than the absolute value of the potential of said select periods.

7. A method of driving a two-terminal type active matrix liquid-crystal display device according to claim 1, wherein the length of the current application periods of said scanning signal is equal to the length of said selection periods.

8. A method of driving a two-terminal type active matrix liquid-crystal display device according to claim 1, wherein the length of the current application periods of said scanning signal is longer than the length of the select periods.

9. A method of driving a two-terminal type active matrix liquid-crystal display device according to claim 1, wherein the current application periods of said scanning signal utilize the select periods of a scanning signal that is applied to other scanning lines.

10. A method of driving a two-terminal type active matrix liquid-crystal display device according to claim 1, wherein the select periods of said scanning signal are continuous with the current application periods that precede said select periods.

11. A method of driving a two-terminal type active matrix liquid-crystal display device according to claim 1, wherein a period is inserted between the current application periods of said scanning signal and the select periods; in said period, a potential is applied to said pixels whereby no current is applied to the two-terminal type switching elements.

12. A method of driving a two-terminal type active matrix liquid-crystal display device according to claim 1, wherein when an intermediate value between a maximum value and a minimum value assumed by said data signal during the respective periods is regarded to be a reference potential, said reference potential undergoes a change during the select periods and during the current application periods that precede said select periods.

13. A two-terminal type active matrix liquid-crystal display device having a plurality of data lines and scanning lines, comprising:

liquid-crystal pixels at intersecting points of said data lines and said scanning lines, each said liquid-crystal pixels having a two-terminal type switching element and a liquid crystal element, said two-terminal type switching elements having bipolar characteristics for both charging and discharging the liquid-crystal element;

control means including a control circuit for controlling said scanning lines, said data lines, said liquid crystal pixels, and said two terminal type switching elements, said liquid crystal display being driven by a scanning signal applied to the scanning lines and by a data signal applied to the data lines in response to a control signal from said control means, said control means controlling the scanning signal, to write an electric charge for storing in a pixel during select periods, to apply a current to said two-terminal type switching elements and discharging the stored charge in said liquid crystal elements by said same bipolar two-terminal type switching elements during current application periods preceding said select periods, and to hold the electric charge of said liquid crystal display elements during holding periods succeeding said select periods;

polarity setting means for determining polarity of the current applied to the two-terminal type switching elements during said current application periods;

voltage setting means for setting a voltage of the current applied to the two-terminal type switching elements; and current application number setting means for setting a number of times of applying the current to said two-terminal type switching elements.

* * * * *